US012351967B2

(12) United States Patent
Smith et al.

(10) Patent No.: US 12,351,967 B2
(45) Date of Patent: Jul. 8, 2025

(54) WASHING MACHINE APPLIANCE NON-SHEDDING LOAD DETECTION

(71) Applicant: Haier US Appliance Solutions, Inc., Wilmington, DE (US)

(72) Inventors: Darrin R. Smith, Louisville, KY (US); Mark William Thomas Worley, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 265 days.

(21) Appl. No.: 17/974,012

(22) Filed: Oct. 26, 2022

(65) Prior Publication Data

US 2024/0141574 A1 May 2, 2024

(51) Int. Cl.

| | |
|---|---|
| ***D06F 33/40*** | (2020.01) |
| *D06F 103/06* | (2020.01) |
| *D06F 103/24* | (2020.01) |
| *D06F 105/48* | (2020.01) |

(52) U.S. Cl.

CPC ..... *D06F 33/40* (2020.02); *D06F 2103/06* (2020.02); *D06F 2103/24* (2020.02); *D06F 2105/48* (2020.02)

(58) Field of Classification Search

CPC ... D06F 34/18; D06F 2103/02; D06F 2103/06
See application file for complete search history.

(56) References Cited

U.S. PATENT DOCUMENTS 5,507,054 A * 4/1996 Blauert ..... D06F 33/30 68/12.12
9,127,388 B2 9/2015 Oh et al.
9,200,401 B2 12/2015 Chung et al.
(Continued)

FOREIGN PATENT DOCUMENTS

DE 102017103430 A1 * 8/2018
KR 20210136376 A * 11/2021
(Continued)

OTHER PUBLICATIONS

KR20210136376—Machine Translation (Year: 2021).*
(Continued)

*Primary Examiner* — Marc Lorenzi
(74) *Attorney, Agent, or Firm* — Dority & Manning, P.A.

(57) ABSTRACT

A washing machine appliance includes a tub and a rotatable basket therein. Methods of operating the washing machine appliance may include, and/or the washing machine appliance may be configured for, measuring a first inertia of a load of articles in the basket by rotating the basket at rotational speeds outside of a resonance speed zone. A water extraction operation is performed after measuring the first inertia of the load of articles. The water extraction operation includes rotating the basket at speeds outside of the resonance speed zone. A second inertia of the load of articles after the water extraction operation is measured by rotating the basket at rotational speeds outside of the resonance speed zone. A load type of the load of articles is determined based on the second inertia. The basket is rotated at speeds within the resonance speed zone only once prior to the water extraction operation.

9 Claims, 9 Drawing Sheets

(56) References Cited

U.S. PATENT DOCUMENTS

| | | | | |
|---|---|---|---|---|
| 9,371,607 | B2 | 6/2016 | Compains Pascualena et al. | |
| 9,863,080 | B2 | 1/2018 | Fugal et al. | |
| 9,890,490 | B2 | 2/2018 | Janke et al. | |
| 10,041,202 | B2 | 8/2018 | Sumer et al. | |
| 10,301,762 | B2 | 5/2019 | Sumer et al. | |
| 2008/0178398 | A1 | 7/2008 | Darby et al. | |
| 2014/0326067 | A1* | 11/2014 | Chanda | D06F 33/34 73/32 R |
| 2019/0194855 | A1 | 6/2019 | Ohyagi et al. | |
| 2021/0340701 | A1 | 11/2021 | Bae | |

FOREIGN PATENT DOCUMENTS

| | | | | |
|---|---|---|---|---|
| WO | WO2014/191248 | A1 | 12/2014 | |
| WO | WO2020/050621 | A1 | 3/2020 | |
| WO | WO-2021037539 | A1 * | 3/2021 | D06F 33/34 |
| WO | WO-2022244962 | A1 * | 11/2022 | D06F 33/32 |

OTHER PUBLICATIONS

WO2021037539—Machine Translation (Year: 2021).*
DE102017103430—Machine Translation (Year: 2018).*
WO2022244962—Machine Translation (Year: 2022).*

* cited by examiner

WASHING MACHINE APPLIANCE NON-SHEDDING LOAD DETECTION

FIELD OF THE INVENTION

The present subject matter relates generally to washing machine appliances and methods for operating washing machine appliances, and more particularly to systems and methods for detecting a non-shedding load of articles in such appliances.

BACKGROUND OF THE INVENTION

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the distribution of the mass of the contents, e.g., a load of articles and wash liquid, on the balance of the basket. For example, the articles and wash liquid within the basket may not be equally weighted about a central axis of the basket and tub. Accordingly, when the basket rotates, in particular during a spin cycle, the imbalance in mass may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the wash liquid and articles during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, e.g., may be suddenly released from the non-shedding article, causing a sudden shift in the center of mass of the contents of the basket. Such shifting of the center of mass may result in an increased likelihood of an out-of-balance condition. For example, in laundry appliances having a balancing system, the balancing system may not recover fast enough in response to the sudden release of wash liquid from within the non-shedding article.

Laundry appliances have a rotational speed or range of rotational speeds at which harmonic resonance occurs, e.g., a resonance speed or resonance speed zone. Rotating the basket at a resonance speed, including one or more resonance speeds within a resonance speed zone or range, may result in increased noise generation and increased potential for an out-of-balance to occur.

Accordingly, a laundry appliance having improved features for determining whether a load of articles therein includes non-shedding articles would be desired. In particular, determining whether a load is a non-shedding load while also minimizing rotation of the basket at resonance speeds, e.g., by minimizing the amount of times the rotational speed of the basket goes through a resonance speed zone while determining the load type, would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a wash tub mounted within the washing machine appliance and a basket rotatably mounted within the wash tub. The method includes rotating the basket at a resonance speed. The method also includes measuring a first inertia of a load of articles in the basket. The first inertia is measured by accelerating the basket to a first speed and decelerating the basket to a second speed less than the first speed. The method further includes performing a water extraction operation after measuring the first inertia of the load of articles and after rotating the basket at the resonance speed. The water extraction operation includes rotating the basket at speeds greater than the resonance speed. The method also includes measuring a second inertia of the load of articles after the water extraction operation by accelerating the basket to a third speed greater than the resonance speed and decelerating the basket to a fourth speed less than the third speed and greater than the resonance speed. The method further includes determining a load type of the load of articles is a non-shedding load type based on the second inertia. The method also includes measuring a third inertia of the load of articles in response to determining the non-shedding load type. The third inertia is measured by rotating the basket at a fifth speed less than the resonance speed and decelerating the basket to a sixth speed less than the fifth speed. The method further includes verifying the non-shedding load type based on the third inertia.

In another aspect of the present disclosure, a method of operating a washing machine appliance is provided. The washing machine appliance includes a wash tub mounted within the washing machine appliance and a basket rotatably mounted within the wash tub. The method includes measuring a first inertia of the load of articles. The method also includes rotating the basket at rotational speeds within a resonance speed zone before a water extraction operation. The method further includes performing the water extraction operation after measuring the first inertia of the load of articles. The water extraction operation includes rotating the basket at speeds greater than the resonance speed zone. The method also includes measuring a second inertia of the load of articles after the water extraction operation. Measuring the second inertia includes rotating the basket at rotational speeds greater than the resonance speed zone. The method further includes determining a load type of the load of articles is a non-shedding load type based on the second inertia and, in response to determining the non-shedding load type, measuring a third inertia of the load of articles. Measuring the third inertia comprises rotating the basket at speeds less than the resonance speed zone. The method also includes verifying the non-shedding load type based on the third inertia.

In a further aspect of the present disclosure, a method of operating a washing machine appliance is provided. The washing machine appliance includes a wash tub mounted within the washing machine appliance and a basket rotatably mounted within the wash tub. The method includes measuring a first inertia of a load of articles in the basket. The first inertia is measured by rotating the basket at rotational speeds outside of a resonance speed zone of the washing machine appliance. The method also includes performing a water extraction operation after measuring the first inertia of the load of articles. The water extraction operation comprises rotating the basket at speeds outside of the resonance speed zone. The method further includes measuring a second inertia of the load of articles after the water extraction operation. The second inertia is measured by rotating the basket at rotational speeds outside of the resonance speed zone. The method also includes determining whether a load type of the load of articles is a non-shedding load type based on the second inertia. The method further includes rotating the basket at speeds within the resonance speed zone only once prior to the water extraction operation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
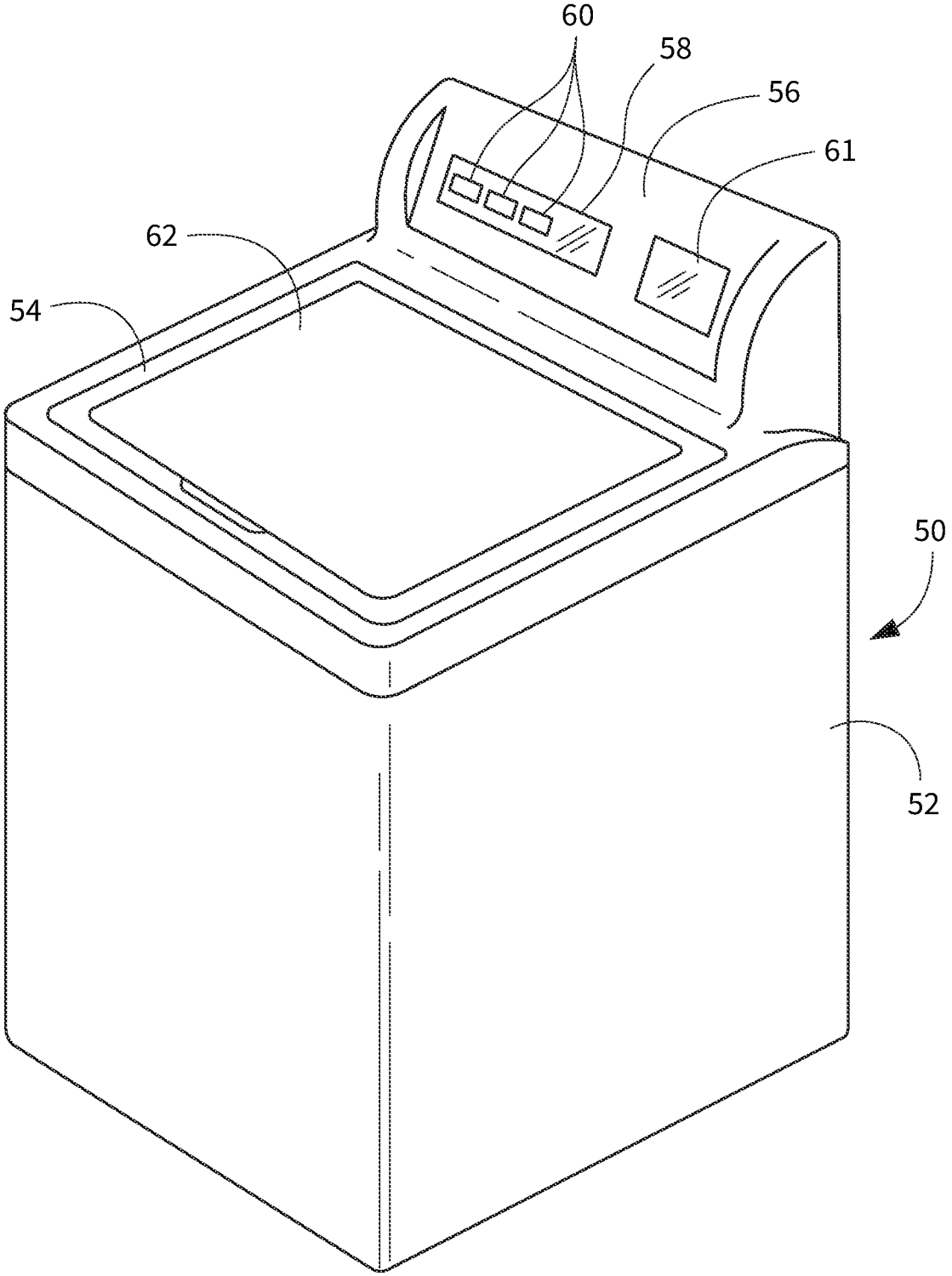
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. As used herein, the terms "first," "second," and "third" may be used interchangeably to distinguish one component or step from another and are not intended to signify order, location, or importance of the individual components or steps.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 provides a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 (FIG. 2) located within cabinet 52, and a closed position (shown in FIG. 1) forming an enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances.

Figure 2:
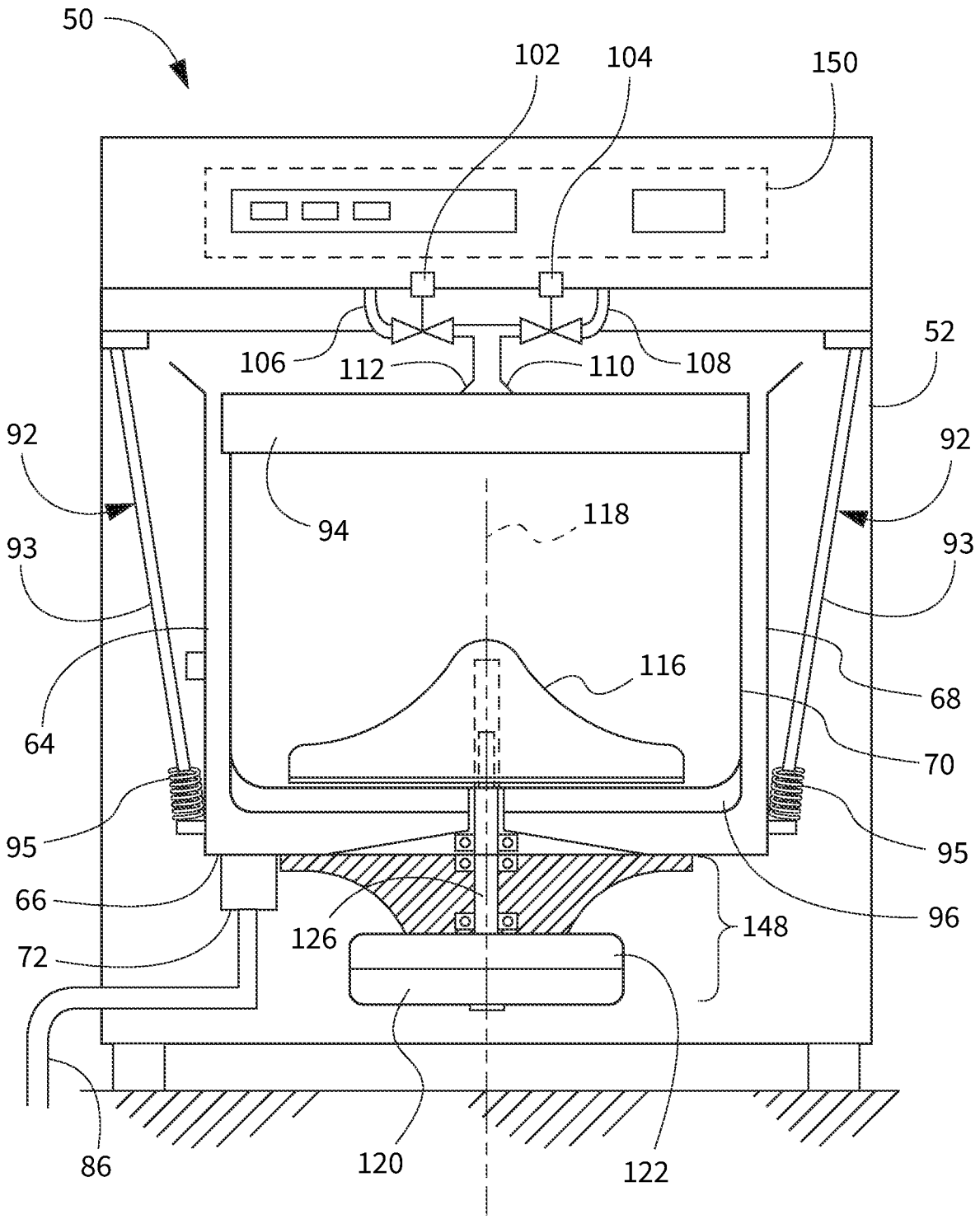
FIG. 2 provides a front, section view of the exemplary washing machine appliance of FIG. 1.

FIG. 2 provides a front elevation schematic view of certain components of an example washing machine appliance 50 including a wash tub 64 and a basket 70 rotatably mounted within wash tub 64. Wash tub 64 includes a bottom wall 66 and a sidewall 68. A pump assembly 72 is located beneath tub 64 and basket 70 for gravity assisted flow when draining tub 64. A pump inlet hose 80 extends from the wash tub 64, e.g., from the bottom wall 66 thereof, to the pump assembly 72, and a pump outlet hose 86 extends from the pump assembly 72 to a building plumbing system discharge line (not shown).

As may be seen in FIG. 2, the wash basket 70 is movably disposed and rotatably mounted in wash tub 64 in a spaced apart relationship from tub side wall 68 and tub bottom wall 66. Basket 70 includes a plurality of perforations therein to facilitate fluid communication between an interior of basket 70 and wash tub 64.

A hot liquid valve 102 and a cold liquid valve 104 deliver liquid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2) may also be provided to produce a liquid or wash solution by mixing fresh water with a detergent and/or other additive for cleansing of articles in basket 70.

Still referring to FIG. 2, an agitation element 116, such as a vane agitator, impeller, auger, or oscillatory basket mechanism, or some combination thereof, is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated, agitation element 116 is oriented to rotate about a vertical axis 118.

Basket 70 and agitation element 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred to herein as a motor assembly 148.

Basket 70, tub 64, and machine drive system 148 are supported by a vibration dampening suspension system. The dampening suspension system generally operates to dampen dynamic motion as the wash basket 70 rotates within the tub 64. The dampening suspension system can include one or more suspension assemblies 92 coupled between and to the cabinet 52 and wash tub 64. Typically, four suspension assemblies 92 are utilized, and are spaced apart about the wash tub 64. For example, each suspension assembly 92 may include a suspension rod 93 connected at one end proximate a corner of the cabinet 52 and at an opposite end to the wash tub 64. The opposite end of the suspension rod 93 connected to the wash tub 64 may be surrounded, e.g., encircled, by a suspension spring 95.

In addition to the vibration dampening suspension assemblies 92, the washer can include other vibration dampening elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

Operation of washing machine appliance 50 is controlled by a controller 150 that is operatively coupled to the user interface input located on washing machine backsplash 56 (shown in FIG. 1) for user manipulation to select washing machine cycles and features. In response to user manipulation of the user interface input, controller 150 operates the various components of washing machine appliance 50 to execute selected machine cycles and features.

Controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 (such as motor assembly 148) may be in communication with controller 150 via one or more signal lines or shared communication busses to provide signals to and/or receive signals from the controller 150.

In an illustrative embodiment, laundry items are loaded into basket 70, and washing operation is initiated through operator manipulation of control input selectors 60 (shown in FIG. 1). Tub 64 is filled with liquid such as water and mixed with detergent to form a wash fluid, and basket 70 is agitated with agitation element 116 for cleansing of laundry items in basket 70. For example, agitation element 116 may be moved back and forth in an oscillatory back and forth motion about vertical axis 118, while basket 70 remains generally stationary (i.e., not actively rotated). Such oscillatory motion may be obtained in different embodiments with a reversing motor, a reversible clutch, or other known reciprocating mechanism. After the agitation phase of the wash cycle is completed, tub 64 is drained with pump assembly 72. Laundry articles can then be rinsed by again adding liquid to tub 64. Depending on the particulars of the cleaning cycle selected by a user, agitation element 116 may again provide agitation within basket 70. After a rinse cycle, tub 64 is again drained, such as through use of pump assembly 72. After liquid is drained from tub 64, one or more spin cycles may be performed. In particular, a spin cycle may be applied after the agitation phase and/or after the rinse phase in order to wring excess wash fluid from the articles being washed. During a spin cycle, basket 70 is rotated at relatively high speeds about vertical axis 118, such as between approximately 450 and approximately 1300 revolutions per minute.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
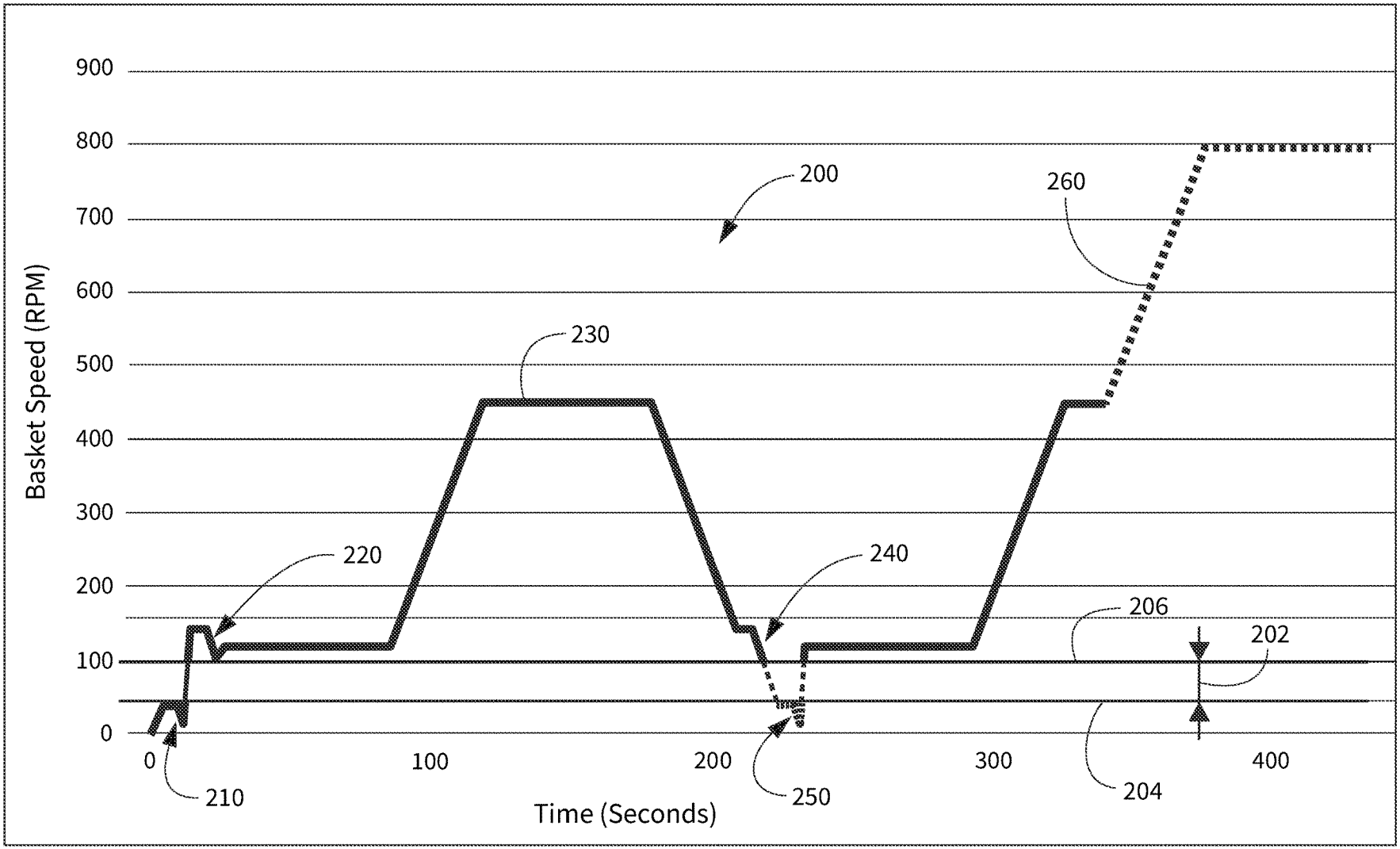
FIG. 3 provides a plot of a basket speed over time during an exemplary operation of a washing machine appliance.

Referring now to FIG. 3, an exemplary plot 200 of basket speed over time during an exemplary operation of a washing machine appliance according to one or more embodiments of the present disclosure is provided. The basket speed may be a rotational speed, e.g., in revolutions per minute (RPM), and the time may be on the order of minutes and seconds or hundreds of seconds.

As may be seen in FIG. 3, the exemplary operation of the washing machine appliance may include one or more measurements of inertia of the load of articles in the basket of the washing machine appliance, e.g., as indicated at 210, 220, 240, and/or 250 in FIG. 3. For example, the exemplary operation of the washing machine appliance may include measuring a first inertia, e.g., a first measurement 210, measuring a second inertia, e.g., a second measurement 220, measuring a third inertia, e.g., a third measurement 240, and measuring a fourth inertia, e.g., a fourth measurement 250. The exemplary operation may also include a water extraction operation 230 and a terminal spin 260, where terminal spin 260 may include rotating the basket at a maximum extraction speed. As may be seen in FIG. 3, the water extraction operation 230 may include rotating the basket at a relatively high speed, which is higher than speeds at which the basket may be rotated during wash and/or rinse sub-cycles, such as an agitation speed or an intermediate dwell speed (e.g., the intermediate dwell speed is about 125 RPM in FIG. 3, as indicated by horizontal portions of plot 200 between measuring the second inertia 220 and the water extraction operation 230 and after measuring the third and/or fourth inertias 240 and/or 250), and which is above the resonance speed or resonance speed zone. The relatively high speed during water extraction operation 230 is thus understood as being "high speed" in comparison to other portions or sub-cycles of the operation. For example, the relatively high speed may be about 450 RPM, e.g., as illustrated in FIG. 3, which is but one of numerous possible high speeds, including multiple distinct high speeds within a single water extraction operation, which may be included in the water extraction operation 230.

As illustrated by the dashed line segment at the upper right of FIG. 3, the exemplary operation may further include the terminal spin 260, and the terminal spin 260 may be at a maximum extraction speed which is greater than the rotational speed of the water extraction operation 230. For example, the maximum extraction speed may be about 600 RPM or greater, such as between about 600 RPM and about 1300 RPM, e.g., about 800 RPM as in the example illustrated in FIG. 3. As will be described further below, the terminal spin 260 may be an optional portion of the exemplary wash operation. For example, embodiments of the present disclosure may include detecting and/or verifying entrapped wash liquid, e.g., a non-shedding load of articles in the basket. Such embodiments may further include one or more remedial actions to limit the effects of the non-shedding load, such as performing a load redistribution operation to try to disgorge entrapped wash liquid from the non-shedding load, and/or limiting a final spin speed, e.g., not spinning the basket up to the maximum extraction speed, when the load of articles in the basket is a non-shedding load type. The load redistribution operation may include rotating the basket and/or an agitator therein, such as oscillating one or both of the basket and agitator back and forth, at a tumble speed (e.g., less than water extraction speed, as will be understood by those of ordinary skill in the art), and may also include draining the wash tub and re-filling the wash tub with a second volume of water. For example, the load redistribution operation may free any water trapped in the folds of the non-shedding articles and promote balancing the load.

Those of ordinary skill in the art will recognize that a washing machine appliance defines one or more resonance speeds, such as multiple successive resonance speeds within a resonance speed zone 202. The resonance speed zone 202 may be a function of the washing machine appliance's dimensions, such as the size, e.g., length, of suspension rods 93 (FIG. 2). The speeds which define the resonance speed zone 202 may be or include a minimum resonance speed 204 and a maximum resonance speed 206. The range of the resonance speed zone 202 for a given washing machine appliance may be determined experimentally, e.g., by running the motor assembly 148 (FIG. 2) and measuring movement, e.g., vibration, of the subwasher (the tub 64, basket 70, and suspension assemblies 92, e.g., such as the exemplary subwasher illustrated in FIG. 2) while rotating at various speeds. The movement of the subwasher may be measured in various ways, such as measuring the movement of the subwasher with an accelerometer and/or gyroscope, or visually analyzing images and/or videos of the subwasher while rotating, such as by human eyes alone or using computer vision, computerized image analysis or other similar automated image analysis, among other possible ways of measuring the movement of the subwasher. For example, the resonance speed zone 202 for a given washing machine appliance may be determined by spinning up the subwasher and observing the motion of the subwasher.

Measuring inertia of the load of articles, e.g., at 210, 220, 240, and/or 250, may include rotating the basket with the articles therein at a range of speeds and determining the inertia of the load of articles based on such rotations. For example, the inertia of the load of articles may be measured by accelerating the basket to a first reference speed, then decelerating the basket, e.g., allowing the basket to coast, to a second reference speed less than the first reference speed. In such embodiments, the inertia of the load of articles may be determined based on the time it takes for the basket to decelerate, e.g., coast, to the second, lower, reference speed. As another example, the inertia of the load of articles may be measured based on the amount of work, e.g., as reflected by an amount of power drawn by a motor of the washing machine appliance, required to accelerate the basket to a reference speed from a starting speed. In such embodiments, the starting speed may be zero, or may be greater than zero but less than the reference speed.

Figure 4:
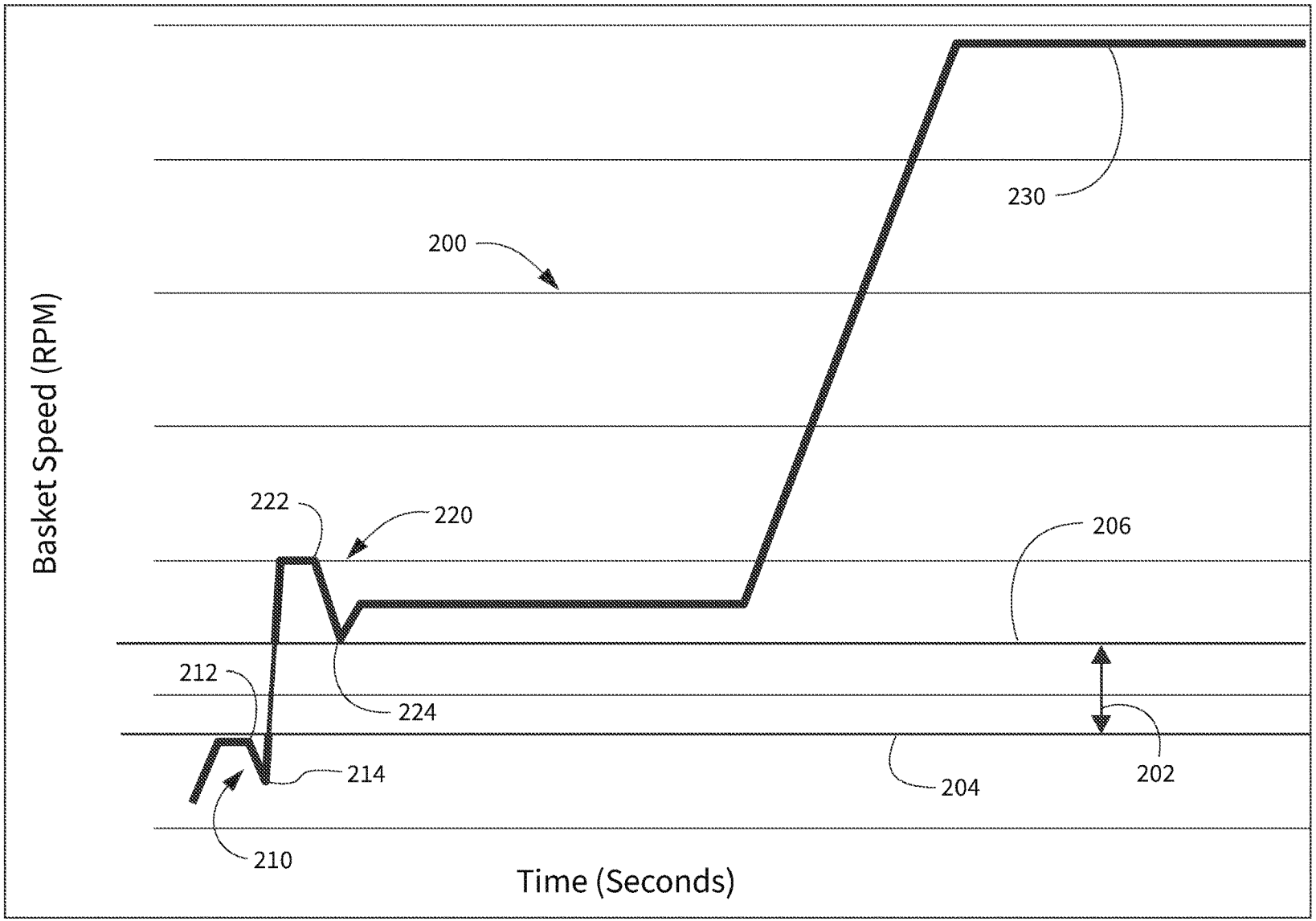
FIG. 4 provides an enlarged view of a portion of the plot of FIG. 3.

For example, as may be best seen in FIG. 4, the first measurement 210 may include accelerating the basket to a first predetermined speed 212, then decelerating, e.g., coasting, the basket to a second predetermined speed 214. In such embodiments, the inertia of the load of articles in the basket may be determined based on how long it takes the basket to coast down to the second predetermined speed 214. Also as may be seen in FIG. 4, measuring the first inertia at first measurement 210 may include rotating the basket at various speeds, such as between and including the first and second predetermined speeds 212 and 214, and all such speeds during the first measurement 210 may be outside of, e.g., less than, the resonance speed zone 202, such as less than the minimum resonance speed 204.

Further, and still with reference to FIG. 4, measuring the second inertia at second measurement 220 may also be based on coast time, as described above, e.g., measuring the second inertia may include accelerating the basket to a third predetermined rotational speed 222 and then coasting to a fourth predetermined rotational speed 224. As may be seen in FIG. 4, the second measurement 220 may be performed entirely outside of the resonance speed zone 202, e.g., the third and fourth predetermined speeds 222 and 224 may both be greater than the resonance speed zone 202, such as greater than the maximum resonance speed 206. Accordingly, while both the first measurement 210 and the second measurement 220 are performed entirely outside of the resonance speed zone 202, the basket speed may pass through the resonance speed zone 202 between the first measurement 210 and the second measurement 220. In at least some embodiments, the basket speed may pass through the resonance speed zone 202 as little as possible, e.g., only one time in the portion of the operation prior to the water extraction operation 230.

Figure 5:
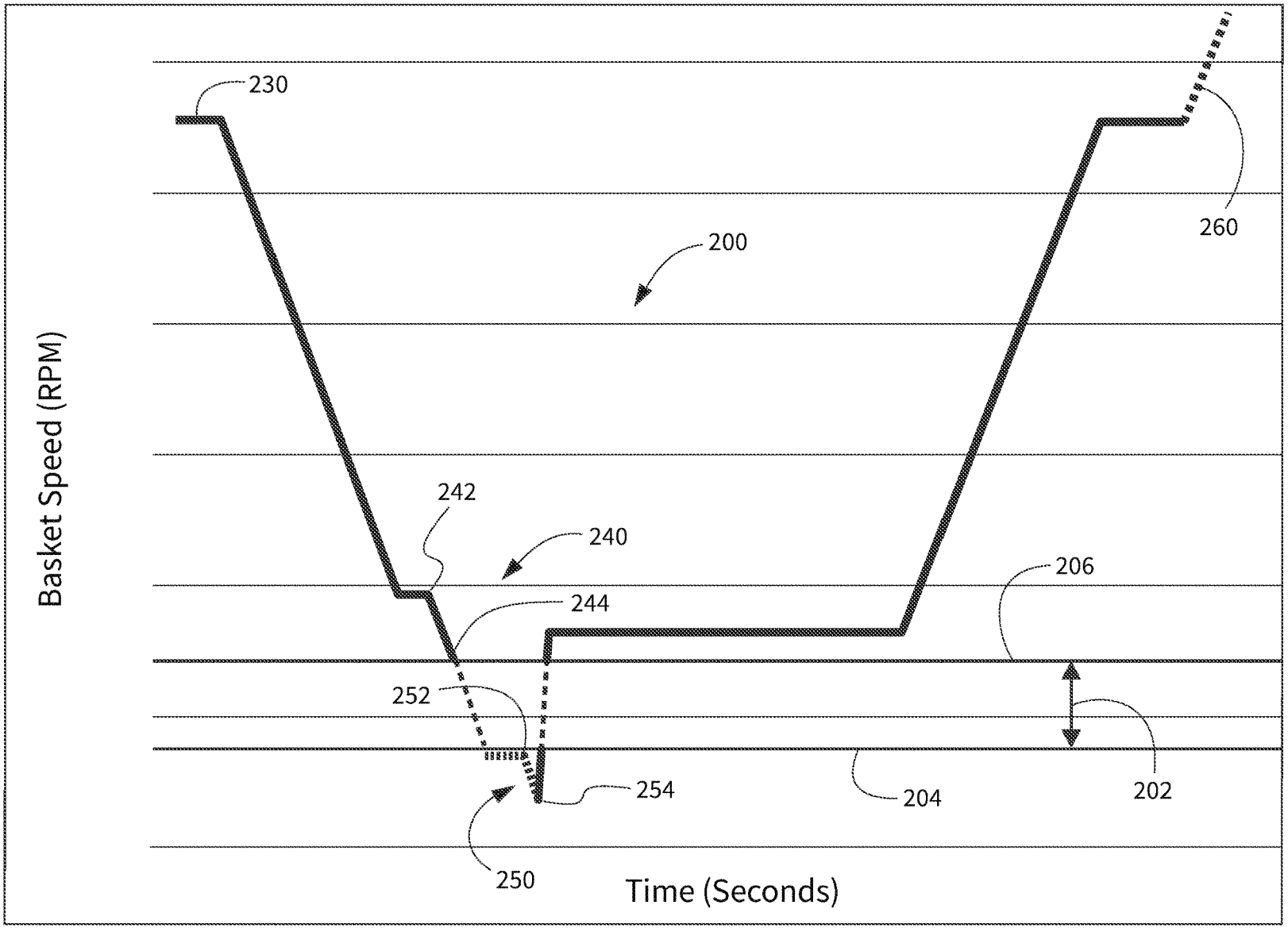
FIG. 5 provides another enlarged view of another portion of the plot of FIG. 3.

As may be seen, e.g., in FIG. 5, the exemplary operation may include a third measurement 240, e.g., measuring a third inertia of the load of articles by rotating the basket at a fifth predetermined reference speed 242 and decelerating the basket to a sixth predetermined reference speed 244 less than the fifth speed 242. Thus, the third measurement 240 may be based on coast time, e.g., as described above with respect to the first and second measurements 210 and 220. As may be seen in FIG. 5, the third measurement may be performed at speeds outside of the resonance speed zone 202, such as greater than the resonance speed zone 202, such as at speeds between and including the sixth predetermined reference speed 244 and the fifth predetermined reference speed 242 all of which are greater than the maximum resonance speed 206.

The inertia measurements may be used to determine a load type of the load of articles in the basket. For example, the load type of the load of articles may be determined based on a comparison of a first inertia, e.g., which is generally a damp or wet inertia before water extraction (e.g., spin cycle) has been performed, to a second inertia, e.g., which is generally a dry inertia, e.g., is measured after the water extraction operation 230, at which point the load of articles is expected to be drier, e.g., to have a significantly lower remaining moisture content, than at the time when the wet inertia was measured. Thus, when the dry inertia is close to the wet inertia, e.g., when a difference between the wet inertia and the dry inertia (that is, a mathematical difference, the wet inertia minus the dry inertia) is less than a predetermined threshold then it may thereby be determined that the load of articles is a non-shedding load, e.g., that water may be entrapped within the load of articles. The load type may also be determined based on a ratio of the wet inertia and the dry inertia, e.g., a non-shedding load may be detected when the wet inertia divided by the dry inertia is less than a predetermined threshold, or a non-shedding load may be detected when the dry inertia divided by the wet inertia is greater than a predetermined threshold. The pre-extraction inertia may also be referred to as a reference inertia and the post-extraction inertia may also be referred to as a compare inertia.

Further, in some embodiments, multiple pre-extraction inertias may be measured and/or multiple post-extraction inertias may be measured. In such embodiments, the load type determination may be based on inertias which are measured at similar speeds, e.g., by comparing a wet inertia or reference inertia that is measured using a reference speed or reference speeds as described above with a dry inertia or compare inertia that is measured using the same or generally the same reference speed(s).

Thus, for example, in embodiments where the second measurement 220 includes rotating the basket at speeds above the resonance speed zone 202 and the third measurement 240 also includes rotating the basket at speeds above the resonance speed zone 202, the second measurement 220 may be a wet inertia (pre-extraction inertia) that is compared with the third measurement 240, where the third measurement 240 may be the dry inertia (post-extraction inertia), to determine a load type of the load of articles in the basket, e.g., whether the load is a non-shedding load. In particular, using the third measurement 240, which is taken at speeds above the resonance speed zone, permits the method to avoid the resonance speed zone 202 after the water extraction operation 230. Further, when the second and third measurements 220 and 240 are both above the resonance speed zone 202 and are compared to determine a load type of the load of articles, in at least some embodiments the second and third measurements 220 and 240 may be taken at generally the same speeds, e.g., the third predetermined reference speed 222 may be generally the same as the fifth predetermined reference speed 242, and each measurement may coast down to generally the same speed, e.g., the fourth predetermined reference speed 224 may be generally the same as the sixth predetermined reference speed 244.

As shown by dashed lines within and below the resonance speed zone 202 in FIG. 5, in some embodiments the exemplary operation may optionally include a fourth measurement 250. For example, as illustrated in FIG. 5, the fourth measurement 250 may include a seventh predetermined reference speed 252 and an eighth predetermined reference speed 254, and the fourth measurement 250 may be based on a coast time from the seventh predetermined reference speed 252 to the eighth predetermined reference speed 254, as described above. In particular, the fourth measurement 250 may be optional, e.g., may be omitted, in order to avoid rotating the basket at a resonance speed, e.g., at any one or more rotational speeds within the resonance speed zone 202. However, the measurements at higher speeds, e.g., the second and third measurements 220 and 240, may be less accurate than the measurements at lower speeds, such as the first and fourth measurements 210 and 250, when used to determine the load type, e.g., non-shedding load type, such as the higher-speed inertia measurements may result in an increased rate of false positive non-shedding load detections as compared to non-shedding load detections based on the first and fourth measurements 210 and 250. Thus, in some embodiments, the exemplary operation may include taking the fourth measurement 250, e.g., measuring a fourth inertia of the load of articles in the basket. The fourth measurement 250 may be compared with the first measurement 210 to verify the load type, e.g., to verify that the load type of the load of articles in the basket is a non-shedding load. The first and fourth measurements 210 and 250 may both be taken at speeds outside of, e.g., less than, the resonance speed zone 202, and may be taken at generally the same speeds.

When the fourth measurement 250 includes rotational speeds at or below the resonance speed zone 202, the operation thus passes through the resonance speed zone 202 before or during measuring the fourth inertia. Accordingly, the fourth measurement 250 may be used to verify a non-shedding load detection, e.g., to reduce instances of false positives, only when a non-shedding load detection based on the second and third measurements 220 and 240 indicates the load of articles in the basket contains or may contain non-shedding article(s) with wash liquid entrapped therein. Thus, the overall method may provide reduced instances of false positive non-shedding load detection and reduced instances of out-of-balance conditions. For example, the instances of out-of-balance conditions may be reduced by avoiding the resonance speed zone, e.g., where the fourth measurement 250 is only performed when an initial load type detection based on the second and third measurements 220 and 240 indicates a non-shedding load.

Additionally, as will be described further herein, one or more remedial actions may also be performed when a non-shedding load type is detected, such as when the initial load type detection indicates a non-shedding load. For example, a load redistribution operation may be performed to attempt to dislodge entrapped wash liquid from the non-shedding load. After such remedial action, the inertia of the load of articles may be measured again and the post-remedial inertia may be compared to the wet inertia, e.g., the second measurement 220, to determine whether a non-shedding load is still indicated, before passing through the resonance speed zone 202 in order to perform the fourth measurement 250 and verify the non-shedding load. Thus, for example, the remedial action(s) may permit avoiding the resonance speed zone, such as when the inertia measured after the remedial action(s) indicates that the load of articles is not a non-shedding load, e.g., when a load type determined based on the post-remedial inertia is not a non-shedding load type. Such may be the case when, for example, the remedial action(s) successfully dislodged the entrapped wash liquid, or when the previous load type determination was a false positive non-shedding load detection for various reasons.

Figure 6:
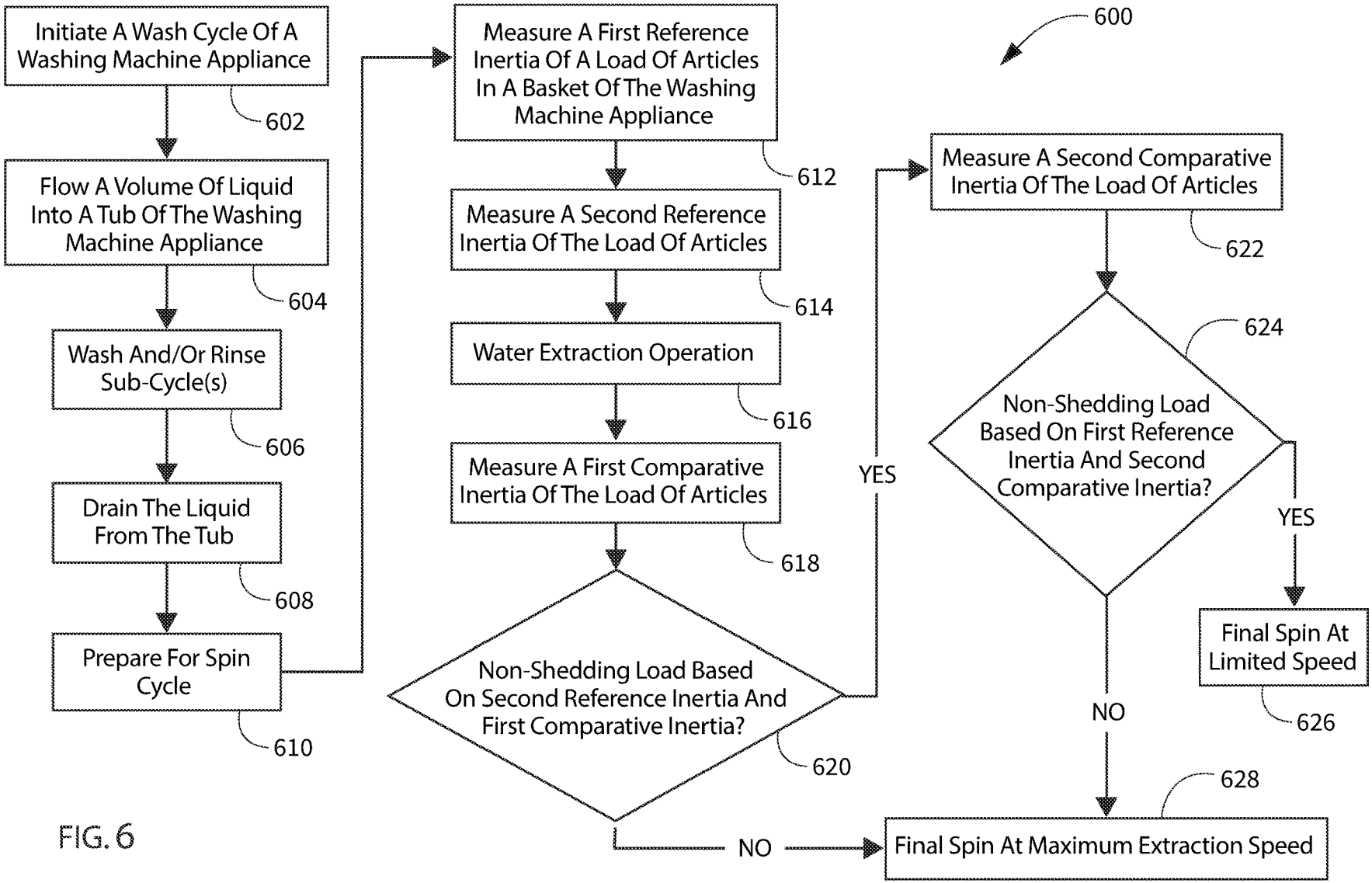
FIG. 6 provides a flow chart illustrating a method for operating a washing machine appliance in accordance with one or more exemplary embodiments of the present disclosure.
Figure 7:
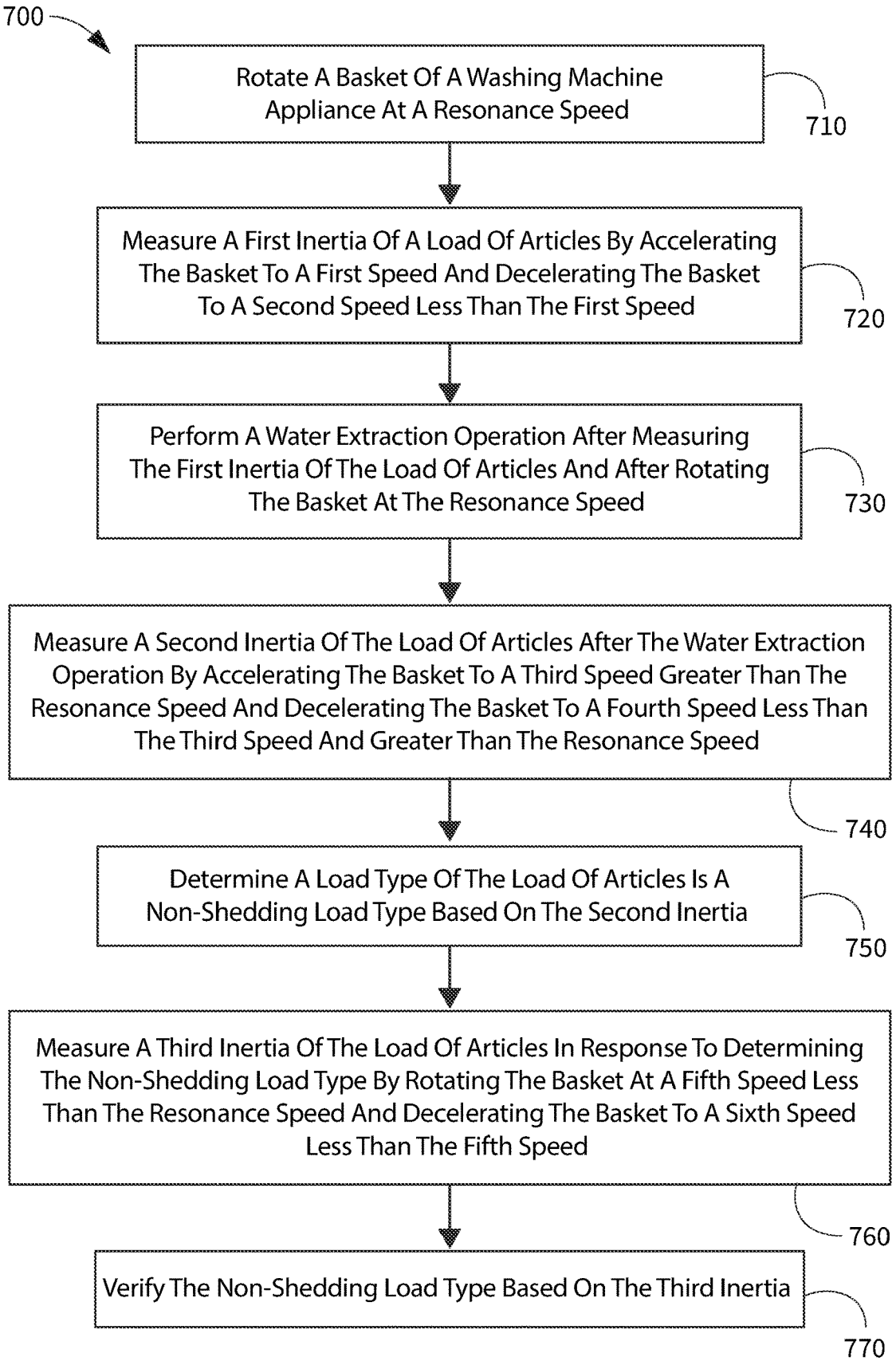
FIG. 7 provides a flow chart illustrating another method for operating a washing machine appliance in accordance with one or more additional exemplary embodiments of the present disclosure.
Figure 8:
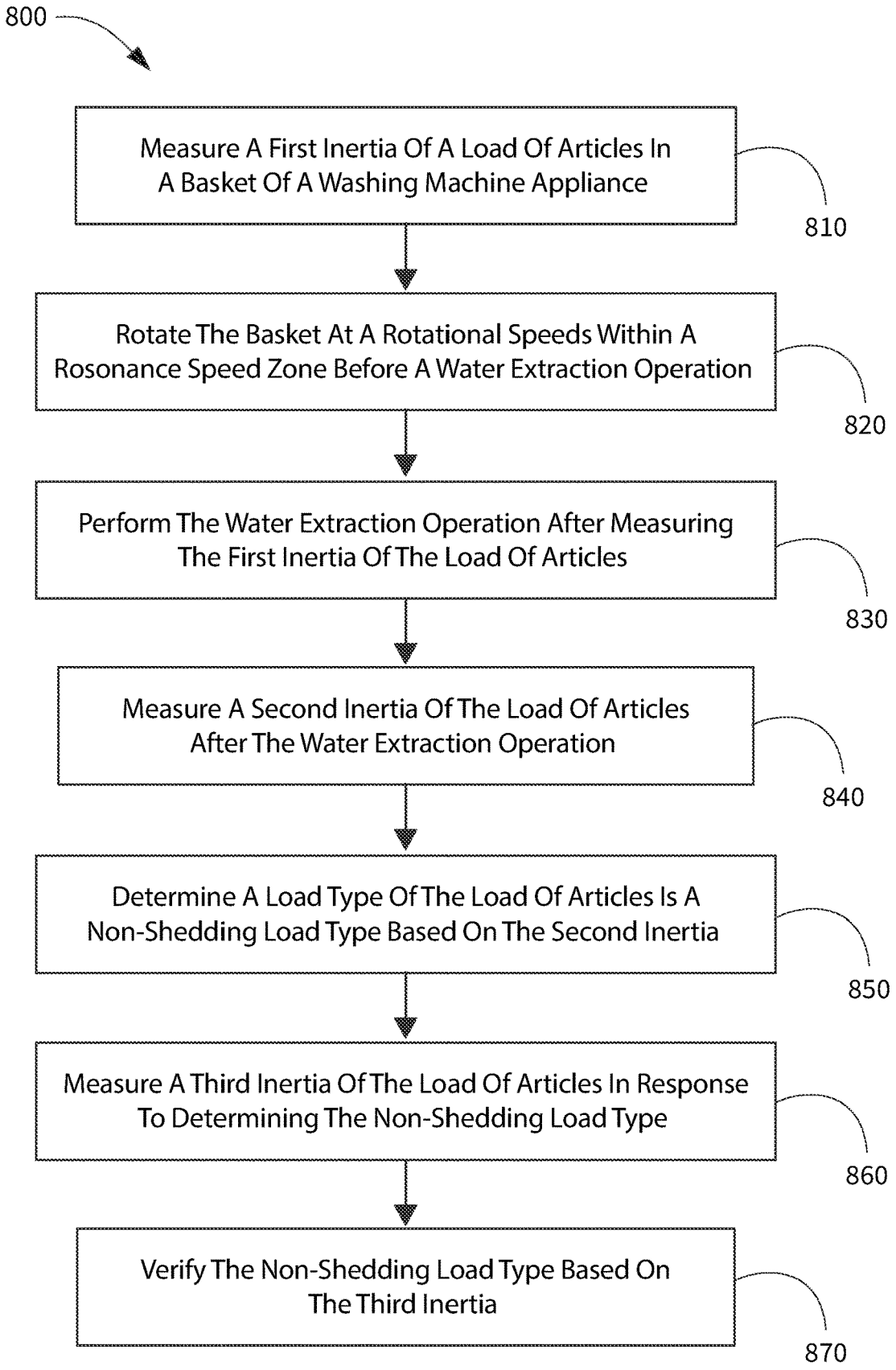
FIG. 8 provides a flow chart illustrating still another method for operating a washing machine appliance in accordance with one or more additional exemplary embodiments of the present disclosure.
Figure 9:
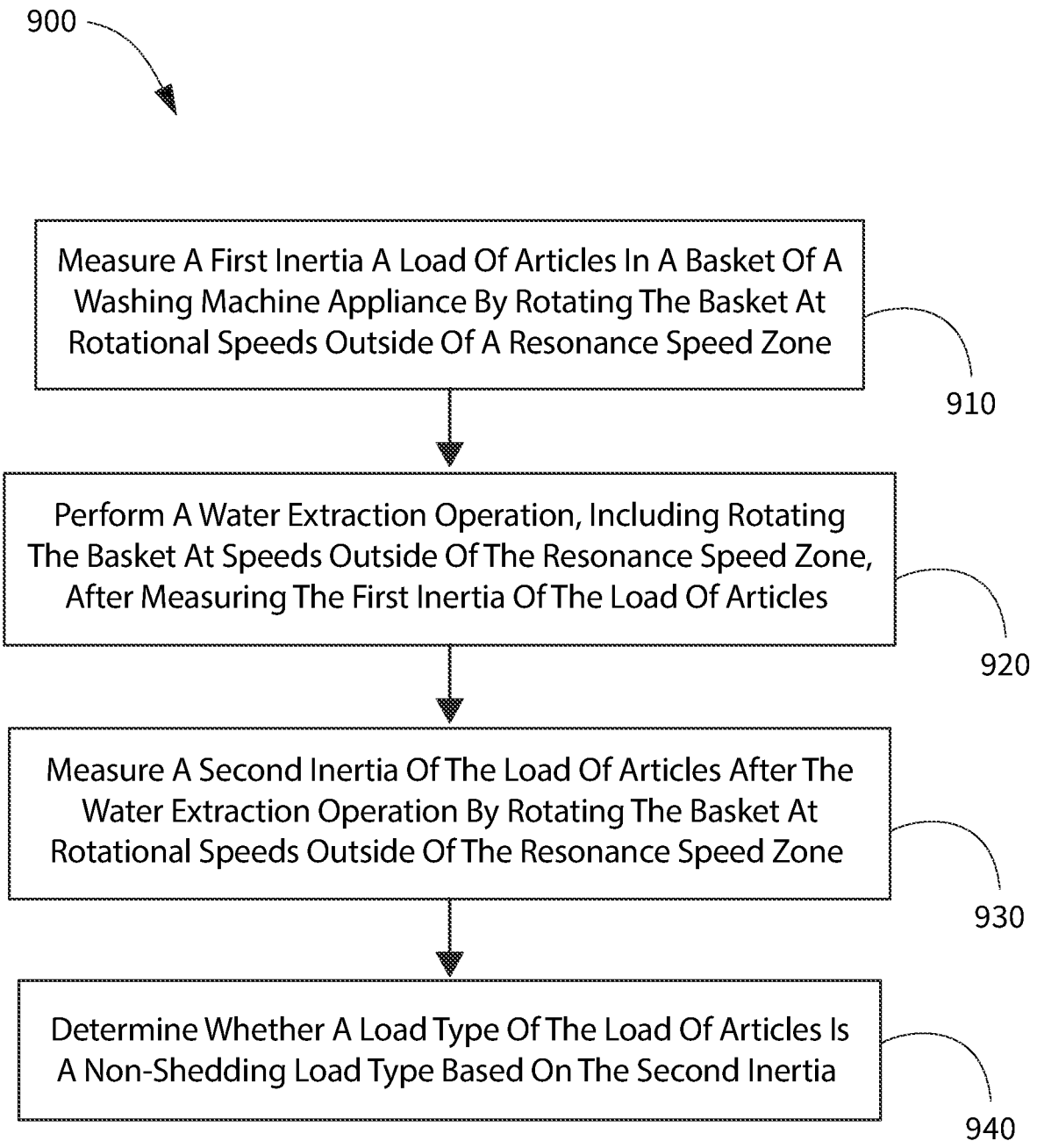
FIG. 9 provides a flow chart illustrating yet another method for operating a washing machine appliance in accordance with one or more additional exemplary embodiments of the present disclosure.

Turning now to FIGS. 6 through 9 generally, embodiments of the present disclosure may also include methods of operating a washing machine appliance, such as the example method 600 illustrated in FIG. 6, the example method 700 illustrated in FIG. 7, the example method 800 illustrated in FIG. 8 and/or the example method 900 illustrated in FIG. 9. Such methods may be used with any suitable washing machine appliance, such as washing machine appliance 50, as described above.

For example, as mentioned above, the washing machine appliance 50 may include a controller 150 and the controller 150 may be operable for, e.g., configured for, performing some or all of the methods and/or steps thereof described herein. For example, one or more method steps may be embodied as an algorithm or program stored in a memory of the controller 150 and executed by the controller 150 in response to a user input such as a selection of a wash operation or rinse operation, etc., of the washing machine appliance 50.

Turning now specifically to FIG. 6 embodiments of the present disclosure include methods of operating a washing machine appliance such as method 600. As illustrated, method 600 may include a step 602 of initiating a wash cycle of the washing machine appliance, e.g., in response to a user input received from a user interface of the washing machine appliance, wherein the controller 150 receives a signal, via a wired or wireless connection, from the user interface and initiates the wash cycle in response to the signal.

Method 600 may further include a step 604 of flowing a volume of water into the wash tub of the washing machine appliance, such as into the wash tub and/or a wash basket mounted therein. As a result of flowing the volume of water into the wash tub, a load of articles in the basket may be wetted. Flowing the volume of water may include, for example, opening a valve, e.g., actuating a valve to an open position, such as one or both valves 102, 104 (FIG. 2) as described above. For example, the valve may be a solenoid valve or other electronically actuated valve in operative communication with a controller of the washing machine appliance, such that flowing the volume of water may include actuating, by the controller, the valve to permit the volume of water to flow into the wash tub.

Still referring to FIG. 6, method 600 may further include one or more wash and/or rinse sub-cycles 606, e.g., segments of the wash cycle which was initiated at step 602. After the one or more wash and/or rinse sub-cycles 606, method 600 may proceed to draining the wash liquid from the tub 608, and preparing for a spin cycle 610.

Method 600 may further include a step 612 of measuring a first reference inertia of a load of articles in the basket of the washing machine appliance, such as prior to rotating the basket at resonance speed(s), such as speeds within the resonance speed zone 202 as described above with reference to FIGS. 3 through 5. Method 600 may also include a step 614 of measuring a second reference inertia of the load of articles, e.g., after measuring the first inertia. Measuring the second reference inertia may include rotating the basket at speeds within and/or greater than the resonance speed zone 202, whereby the basket is rotated at one or more resonance speeds before and/or during the second reference inertia measurement. The first and second reference inertias may be measured in various ways, such as based on power required to accelerate the basket with the load of articles therein, time for the basket and articles therein to coast to a predetermined speed, and other suitable methods, including combinations thereof.

In some example embodiments, the first reference inertia may be measured at speeds below the resonance speed zone and the second reference inertia may be measured at speeds above the resonance speed zone, whereby the basket accelerates through the resonance speed zone between measuring the first reference inertia and measuring the second reference inertia. The first and second reference inertias may each be "wet" inertias, e.g., measured prior to a water extraction operation, e.g., as described above. Thus, one or both of the first and second reference inertias may be compared to a post-extraction inertia measurement, which may also be referred to as a comparative inertia, to determine or verify a load type of the load of articles in the basket.

Method 600 may also include a step 616 of performing a water extraction operation, e.g., such as the water extraction operation 230 described above or other similar operations wherein the basket is rotated at speeds less than the final terminal speed (e.g., less than maximum extraction speed) but fast enough to wring moisture from the articles and/or to centrifugally extract moisture from the basket and/or from articles therein.

A first comparative inertia may be measured after the water extraction operation, e.g., as indicated at 618 in FIG. 6. For example, where the water extraction operation is performed at speeds above the resonance speed zone, measuring the first comparative inertia may also include rotating the basket at speeds above the resonance speed zone, such as only rotating the basket at speeds above the resonance speed zone throughout the first comparative inertia measurement, whereby the basket is not rotated at a resonance speed between the water extraction operation and measuring the first comparative inertia. As noted above with respect to the reference inertias, the first comparative inertia may be measured using any suitable technique.

In some embodiments, method 600 may further include determining a load type of the load of articles based on the second reference inertia and the first comparative inertia, e.g., as indicated at 620 in FIG. 6. In some embodiments, the second reference inertia may be or correspond to the result of the second measurement 220, e.g., the inertia measured at 220, as described above with reference to FIGS. 3 through 5, and the first comparative inertia may be or correspond to the result of the third measurement 240 as described above with respect to FIGS. 3 through 5. Thus, in some embodiments, the load type may be determined based on the second reference inertia and the first comparative inertia such as based on a difference or a ratio between the second reference inertia and the first comparative inertia.

As may be seen in FIG. 6, when the load type determination at 620 results in not finding a non-shedding load, the method 600 may then proceed with a final spin at maximum extraction speed 628. Also as illustrated in FIG. 6, when the determination at 620 results in a non-shedding load type being detected, the method 600 may then proceed to verifying the non-shedding load type. Verifying the non-shedding load type may include measuring a second comparative inertia 622, such as at speeds outside of, e.g., below, the resonance speed zone of the washing machine appliance and verifying the non-shedding load based on the first reference inertia and the second comparative inertia, e.g., as indicated at 624 in FIG. 6. For example, the first reference inertia and the second comparative inertia may both be measured at speeds below the resonance speed zone, such as at about the same speeds. Accordingly, the non-shedding load verification at step 624 may be more accurate, e.g., less likely to produce a false positive. Also, where the first reference inertia is measured below the resonance speed zone and before passing through the resonance speed zone, and the second comparative inertia is measured below the reference speed zone and after the water extraction operation (which is performed above the resonance speed zone), the method 600 passes through the resonance speed zone multiple times while determining the load type when the second comparative inertia is included, such as after the first reference inertia (and which would occur regardless as the basket rotation speed ramps up) and before the second comparative inertia is measured. In other conditions, e.g., when the load type determined based on the second reference inertia and the first comparative inertia is not a non-shedding load type, the method 600 only passes through the resonance speed zone once.

Referring still to FIG. 6, the method 600 may proceed to the final spin at maximum extraction speed 628 when the non-shedding load type is not verified, e.g., when the result at 624 is "NO." When the non-shedding load type is verified, e.g., when the result at 624 is "YES," the method 600 may proceed to a remedial action, such as a final spin at limited speed 626, e.g., wherein the terminal speed of the spin operation is less than the full terminal speed and/or less than the maximum extraction speed.

Turning now to FIG. 7, another exemplary method 700 of operating a washing machine appliance according to one or more embodiments of the present invention may include a step 710 of rotating a basket of the washing machine appliance at a resonance speed, such as at one or more resonance speeds within a resonance speed zone. For example, step 710 may occur during an initial ramp-up phase of a wash cycle, such as a spin sub-cycle of the wash cycle, in the washing machine appliance. In various embodiments, the step 710 may occur before or after measuring a first inertia, e.g., as illustrated at step 720 in FIG. 7. For example, measuring the first inertia may include measuring the first inertia of the load of articles in the basket by accelerating the basket to a first speed and decelerating the basket to a second speed less than the first speed. In various embodiments, the first speed and the second speed may be less than the resonance speed or resonance speed zone, such as when the step 720 of measuring the first inertia is performed before the step 710 of rotating the basket at the resonance speed, or the first speed and the second speed may be greater than the resonance speed or resonance speed zone, such as when the step 720 of measuring the first inertia is performed after the step 710 of rotating the basket at the resonance speed. For example, in various embodiments, the first inertia of step 720 in method 700 may be measured at the first measurement 210 in FIGS. 3 and 4, or at the second measurement 220 in FIGS. 3 and 4. In additional example embodiments, the first inertia of step 720 in method 700 may also or instead be one of the reference inertias in FIG. 6, e.g., the first reference inertia measured at 612 or the second reference inertia measured at 614.

Method 700 may further include a step 730 of performing a water extraction operation after measuring the first inertia of the load of articles and after rotating the basket at the resonance speed. The water extraction operation may include rotating the basket at speeds greater than the resonance speed. For example, the water extraction operation may be water extraction operation 230 of FIGS. 3 through 5, and/or water extraction operation 616 of FIG. 6.

In some embodiments, method 700 may also include a step 740 of measuring a second inertia of the load of articles after the water extraction operation by accelerating the basket to a third speed greater than the resonance speed and decelerating the basket to a fourth speed less than the third speed and greater than the resonance speed. For example, the second inertia in step 740 may be a "dry" inertia such as the first comparative inertia described above, e.g., the second inertia in step 740 may be or correspond to the third measurement 240 and/or the first comparative inertia. Method 700 may then include a step 750 of determining a load type of the load of articles is a non-shedding load type based on the second inertia, such as based on a comparison (e.g., difference or ratio) of the second inertia and the first inertia from step 720 or another inertia other than the first inertia from step 720 which was measured before the water extraction operation.

Method 700 may further include a step 760, in response to determining the non-shedding load type. Step 760 may include measuring a third inertia of the load of articles by rotating the basket at a fifth speed less than the resonance speed and decelerating the basket to a sixth speed less than the fifth speed. Method 700 may then include a step 770 of verifying the non-shedding load type based on the third inertia. For example, the third inertia may be a "dry" inertia as described above, and may be compared to a "wet" inertia measured at the same or similar speeds prior to the water extraction operation. Also by way of example, the third inertia may be the second comparative inertia, e.g., as described above with reference to FIG. 6.

In some embodiments, the first inertia at step 720 may be measured before rotating the basket at the resonance speed. In such embodiments, method 700 may also include, after rotating the basket at the resonance speed and before performing the water extraction operation, measuring a fourth inertia of the load of articles by accelerating the basket to a seventh speed greater than the resonance speed and decelerating the basket to an eighth speed less than the seventh speed and greater than the resonance speed. For example, in such embodiments the first inertia may be the first measurement 210 and/or the first reference inertia, and the fourth inertia may be the second measurement 220 and/or the second reference inertia. In such embodiments, determining the load type of the load of articles is the non-shedding load type based on the second inertia at step 750 may include comparing the fourth inertia and the second inertia.

As mentioned above, the load type may be determined by comparing inertias measured before and after the water extraction operation and at generally the same speeds. Thus, for example, in some embodiments, the fifth speed may be approximately equal to the first speed and the sixth speed may be approximately equal to the second speed.

In some embodiments, verifying the load type based on the third inertia at step 770 may include comparing the first inertia and the third inertia. In such embodiments, the first inertia may be measured before step 710 and may be measured at sub-resonance speeds, e.g., entirely at speeds less than the resonance speed zone.

In some embodiments, the first inertia may be measured after rotating the basket at the resonance speed, e.g., at second measurement 220 and/or the first inertia may be the second reference inertia of FIG. 6. In such embodiments, the first speed may be greater than the resonance speed and the second speed may also be greater than the resonance speed. Further, such embodiments may also include determining the load type of the load of articles is the non-shedding load type based on the second inertia at step 750 by comparing the first inertia and the second inertia. In such embodiments, method 700 may also include, before rotating the basket at the resonance speed, measuring a fourth inertia of the load of articles by accelerating the basket to a seventh speed less than the resonance speed and decelerating the basket to an eighth speed less than the seventh speed, e.g., the fourth inertia in such embodiments may be the fourth measurement 250 and/or the second comparative inertia. In such embodiments, verifying the non-shedding load type based on the third inertia may include comparing the fourth inertia and the third inertia.

Turning now to FIG. 8, in additional exemplary embodiments, a method 800 of operating a washing machine appliance may include a step 810 of measuring a first inertia of a load of articles in the basket of the washing machine appliance. Method 800 may also include a step 820 of rotating the basket at rotational speeds within a resonance speed zone before a water extraction operation, e.g., passing through the resonance speed zone while ramping up to the water extraction operation speed. Steps 810 and 820 may be performed in different orders in various embodiments of method 800, such as measuring the first inertia before or after rotating the basket at rotational speeds within the resonance speed zone. Thus, in various embodiments, measuring the first inertia in step 810 may be performed above or below the resonance speed zone, e.g., measuring the first inertia may be the first measurement 210 in some embodiments or the second measurement 220 in other embodiments, and/or may be the first reference inertia or the second reference inertia.

Method 800 may further include a step 830 of performing the water extraction operation after measuring the first inertia of the load of articles. The water extraction operation may include rotating the basket at speeds greater than the resonance speed zone.

In some embodiments, method 800 may also include a step 840 of measuring a second inertia of the load of articles after the water extraction operation. In such embodiments, measuring the second inertia may include rotating the basket at rotational speeds greater than the resonance speed zone, e.g., measuring the second inertia may be or include the third measurement 240 and/or the first comparative inertia. Such embodiments may further include a step 850 of determining a load type of the load of articles is a non-shedding load type based on the second inertia, e.g., based on the second inertia compared to a pre-extraction inertia or wet inertia, such as based on the second inertia compared to the first inertia from step 810.

In response to determining the non-shedding load type, method 800 may include measuring a third inertia of the load of articles, e.g., as indicated at 860 in FIG. 8. Measuring the third inertia comprises rotating the basket at speeds less than the resonance speed zone, e.g., as described above with reference to fourth measurement 250 and/or the second comparative inertia. The non-shedding load type may then be verified based on the third inertia, e.g., as indicated at 870 in FIG. 8, such based on the third inertia compared to the first inertia from step 810 or another pre-extraction "wet" inertia.

In some embodiments, measuring the first inertia may include rotating the basket at speeds outside of the resonance speed zone, such as less than the resonance speed zone, e.g., when the first inertia is measured before rotating the basket at the rotational speeds within the resonance speed zone, or such as greater than the resonance speed zone, e.g., when the first inertia is measured after rotating the basket at the rotational speeds within the resonance speed zone.

In some embodiments, measuring the first inertia may include rotating the basket at speeds less than the resonance speed zone. In such embodiments, verifying the non-shedding load type based on the third inertia may include comparing the first inertia and the third inertia. Such embodiments may also include, before performing the water extraction operation, measuring a fourth inertia of the load of articles. Measuring the fourth inertia may include rotating the basket at rotational speeds greater than the resonance speed zone. In such embodiments, determining the load type of the load of articles is the non-shedding load type may include comparing the fourth inertia and the second inertia.

In some embodiments, measuring the first inertia may include rotating the basket at speeds greater than the resonance speed zone. In such embodiments, determining the load type of the load of articles is the non-shedding load type may include comparing the first inertia and the second inertia. Such embodiments may further include measuring a fourth inertia of the load of articles before performing the water extraction operation, e.g., the fourth inertia in such embodiments may be the first measurement 210 and/or the first reference speed. In such embodiments, measuring the fourth inertia may include rotating the basket at rotational speeds less than the resonance speed zone, and verifying the non-shedding load type based on the third inertia may include comparing the fourth inertia and the third inertia.

Turning now to FIG. 9, another exemplary method 900 of operating a washing machine appliance include a step 910 of measuring a first inertia of a load of articles in the basket by rotating the basket at rotational speeds outside of, e.g., greater than or less than, a resonance speed zone of the washing machine appliance.

The exemplary method 900 may also include a step 920 of performing a water extraction operation after measuring the first inertia of the load of articles. The water extraction operation may include rotating the basket at speeds outside of the resonance speed zone.

The exemplary method 900 may further include a step 930 of measuring a second inertia of the load of articles after the water extraction operation by rotating the basket at rotational speeds outside of, e.g., less than or greater than, the resonance speed zone.

The exemplary method 900 may also include a step 940 of determining whether a load type of the load of articles is a non-shedding load type based on the second inertia, such as based on a comparison of the second inertia with the first inertia from step 910, or with another pre-extraction inertia. The method 900 may also include rotating the basket at speeds within the resonance speed zone only once prior to the water extraction operation.

In some embodiments, the step 940 of determining whether the load type of the load of articles is the non-shedding load type based on the second inertia may include determining the load type of the load of articles is the non-shedding load type. Such embodiments may further include, in response to determining the non-shedding load type, measuring a third inertia of the load of articles by rotating the basket at rotational speeds outside of the resonance speed zone, and verifying the non-shedding load type based on the third inertia.

In some embodiments, the step 940 of determining whether the load type of the load of articles is the non-shedding load type based on the second inertia may include determining the load type of the load of articles is not the non-shedding load type. In such embodiments, the method 900 may not include rotating the basket at speeds within the resonance speed zone after the water extraction operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a wash tub mounted within the washing machine appliance and a basket rotatably mounted within the wash tub, the method comprising:

flowing a volume of water into the wash tub;

rotating the basket at a resonance speed;

measuring a first inertia of a load of articles in the basket by accelerating the basket to a first speed and decelerating the basket to a second speed less than the first speed;

performing a water extraction operation after measuring the first inertia of the load of articles and after rotating the basket at the resonance speed, wherein the water extraction operation comprises rotating the basket at speeds greater than the resonance speed;

measuring a second inertia of the load of articles after the water extraction operation by accelerating the basket to a third speed greater than the resonance speed and decelerating the basket to a fourth speed less than the third speed and greater than the resonance speed;

determining a load type of the load of articles is a non-shedding load type based on the second inertia;

measuring a third inertia of the load of articles in response to determining the non-shedding load type by rotating the basket at a fifth speed less than the resonance speed and decelerating the basket to a sixth speed less than the fifth speed;

verifying the non-shedding load type based on the third inertia; and implementing one or more remedial actions in response to the verified non-shedding load type, wherein the one or more remedial actions comprises one or more of a load redistribution operation and limiting a final spin speed.

2. The method of claim 1, wherein the first inertia is measured before rotating the basket at the resonance speed.

3. The method of claim 2, further comprising, after rotating the basket at the resonance speed and before performing the water extraction operation, measuring a fourth inertia of the load of articles by accelerating the basket to a seventh speed greater than the resonance speed and decelerating the basket to an eighth speed less than the seventh speed and greater than the resonance speed.

4. The method of claim 3, wherein determining the load type of the load of articles is the non-shedding load type based on the second inertia comprises comparing the fourth inertia and the second inertia.

5. The method of claim 1, wherein the fifth speed is approximately equal to the first speed and the sixth speed is approximately equal to the second speed.

6. The method of claim 1, wherein verifying the non-shedding load type based on the third inertia comprises comparing the first inertia and the third inertia.

7. The method of claim 1, wherein the first inertia is measured after rotating the basket at the resonance speed, wherein the first speed is greater than the resonance speed and the second speed is greater than the resonance speed, and wherein determining the load type of the load of articles is the non-shedding load type based on the second inertia comprises comparing the first inertia and the second inertia.

8. The method of claim 7, further comprising, before rotating the basket at the resonance speed, measuring a fourth inertia of the load of articles by accelerating the basket to a seventh speed less than the resonance speed and decelerating the basket to an eighth speed less than the seventh speed.

9. The method of claim 8, wherein verifying the non-shedding load type based on the third inertia comprises comparing the fourth inertia and the third inertia.

* * * * *